US006239541B1

(12) United States Patent
Fujisawa

(10) Patent No.: US 6,239,541 B1
(45) **Date of Patent: *May 29, 2001**

(54) RFQ ACCELERATOR AND ION IMPLANTER TO GUIDE BEAM THROUGH ELECTRODE-DEFINED PASSAGE USING RADIO FREQUENCY ELECTRIC FIELDS

(75) Inventor: Hiroshi Fujisawa, Kyoto (JP)

(73) Assignee: Nissin Electric Co., Ltd., Kyoto (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/194,179

(22) PCT Filed: Mar. 26, 1998

(86) PCT No.: PCT/JP98/01339

§ 371 Date: Nov. 24, 1998

§ 102(e) Date: Nov. 24, 1998

(87) PCT Pub. No.: WO98/44767

PCT Pub. Date: Oct. 8, 1998

(30) Foreign Application Priority Data

Mar. 27, 1997 (JP) ..... 9-095058

(51) Int. Cl.[7] ..... H05H 9/02

(52) U.S. Cl. ..... 313/359.1; 313/360.1; 315/505; 315/506

(58) Field of Search ..... 313/359.1, 62, 313/157, 158, 159, 360.1; 315/500, 505, 506, 507, 5.41, 5.39, 5.42, 5.43, 5.46, 5.47

(56) References Cited

U.S. PATENT DOCUMENTS 4,560,905 * 12/1985 Maschke ..... 313/382
4,667,111 5/1987 Glavish et al. .
4,712,042 * 12/1987 Hamm ..... 313/359.1
5,422,549 * 6/1995 Shepard et al. ..... 315/505

FOREIGN PATENT DOCUMENTS

DE 3644797 A1 7/1988 (DE) .
5-74596 3/1993 (JP) .
6-290731 10/1994 (JP) .

OTHER PUBLICATIONS

I.M. Kapchinskii, et al., "Linear Ion Accelerator with Spatially Homogenous Strong Focusing", *Nuclear Experimental Techniques*, pp. 322–326, 1969.

(List continued on next page.)

*Primary Examiner*—Nimeshkumar D. Patel
*Assistant Examiner*—Joseph Williams
(74) *Attorney, Agent, or Firm*—Staas & Halsey LLP

(57) ABSTRACT

RFQ electrodes for use as an acceleration tube of a high energy ion implanter, capable of accelerating an ion beam of large current without divergence are arranged, with respect to a low resonance frequency of substantially 33 MHz suitable for heavy ions such as B, P, and As, such that a radius $R_1$ of a beam passage spacing surrounded by four RFQ electrodes is 5 mm to 9 mm, a curvature $R_2$ in a direction perpendicular to an axis of a crest portion of repetitive crest and trough portions on surfaces of the electrodes in a beam propagation direction is 5 mm to 9 mm, and a height H from a peak of the crest portion to a bottom surface is set so that $H/R_1$ is 4 to 6. When the height H of the electrodes is reduced, while shunt impedance is increased and power efficiency is improved, a cooling ability becomes insufficient due to the fact that a cross section of a coolant channel cannot be increased, and a problem is presented that oscillation of electrodes is likely to occur due to insufficient mechanical strength. However, by adopting the above arrangement, an optimum configuration of the RFQ electrodes is obtained, in which power efficiency is high, cooling efficiency is superior, a mechanical strength is sufficient, and beam acceptance is large.

6 Claims, 7 Drawing Sheets

OTHER PUBLICATIONS

J. Stovall, et al., "Performance Characteristics of A 425–MHz RFQ Linac", *IEEE Transactions on Nuclear Science*, vol. NS–28, No. 2, Apr. 1981, pp. 1508–1510.

N. Ueda, et al., "Construction of the RFQ 'TALL'"; *IEEE Transactions on Nuclear Science*, vol. NS–32, No. 5, Oct. 1985, pp. 3178–3180.

R. M. Hutcheon, "A Modeling Study of the Four–Rod RFQ", *Proceedings of the 1984 Linear Accelerator Conference*, May 7–11, 1984, pp. 94–96.

A. Schempp et al., "Zero–Mode–RFQ Development in Frankfurt", *Proceedings of the 1984 Linear Accelerator Conference*, May 7–11, 1984, pp. 100–102.

* cited by examiner

RFQ ACCELERATOR AND ION IMPLANTER TO GUIDE BEAM THROUGH ELECTRODE-DEFINED PASSAGE USING RADIO FREQUENCY ELECTRIC FIELDS

FIELD OF THE INVENTION

The present invention relates to an RFQ accelerator and an ion implanter provided with thereof for use in ion irradiation and ion implantation, and particularly relates to an improvement in electrode configuration of such an RFQ accelerator.

BACKGROUND OF THE INVENTION

An RFQ accelerator is capable of accelerating an ion beam with a focusing force and thus capable of accelerating an ion beam of large current without divergence, and therefore is used as a high energy ion acceleration tube of a high energy ion implanter. The RFQ accelerator also has its application as an ion accelerator of experimental, analytical, and medical use.

As representative accelerators of charged particles, circular accelerator and linear accelerator are available. The circular accelerator, such as cyclotron, accelerates a beam in a circular motion and the linear accelerator accelerates a beam in a linear motion. The RFQ accelerator is an example of the latter. The linear accelerator works under the principle that ions are accelerated by application of a DC (Direct Current) high voltage between hollow electrodes. In this case, when the acceleration energy is qV, a DC power source capable of generating a high voltage V is required. Thus, in order to realize acceleration of several MeV, which is required in high energy ion implanters, a high voltage power source in the order of MV is required, and the power source section alone takes up a large space. Also, in such an accelerator for carrying out high energy acceleration, a vacuum chamber for passing a beam is required to have a large volume. As a result, the high energy accelerator such as above is inevitably large and expensive.

Meanwhile, in recent years, a demand for ion implantation with a high energy of several MeV has been increasing in semiconductor industry. However, to realize production in an industrial setting, a large device, which takes no account of costs, fails to meet such a demand, and there is a need for new and smaller accelerator capable of high energy acceleration.

As an accelerator suitable for such purpose, an RFQ accelerator has been getting an attention. The RFQ accelerator is one of relatively newer linear accelerators, and has a schematic arrangement wherein four electrodes are placed on a position corresponding to vertices of a square, and the electrodes on a diagonal line are connected to each other, and a radio-frequency voltage is induced between adjacent electrodes.

Namely, the four electrodes constitute a quadrupole, and a radio-frequency is applied between adjacent electrodes. Instead of applying a DC high voltage between electrodes which are separated from one another in a beam propagation direction, radio-frequency is induced between four electrodes parallel to the beam propagation direction. The radio-frequency is applied to quadrupole electrodes in this manner, thus the name RFQ, which stands for Radio-Frequency Quadrupole.

The RFQ accelerator was first proposed by Kapchinskii and Teplyakov (I. Kapchinskii and V. Teplyakov Prib. Tekh, Eksp.2 (1970) p.19). Then, it was first confirmed in 1981 that the RFQ accelerator is actually capable of carrying out acceleration in the Los Alamos National Laboratory of the United States (J. E. Stovall, K. R. Crandall and R. W. Hamm, IEEE Trans. Nucl. Sci, NS-28 (1981) P.1508).

Such an RFQ accelerator has a schematic structure wherein four electrodes (for example, A, B, C, and D in counterclockwise direction) are placed on a position corresponding to vertices of a square on a plane perpendicular to a beam propagation direction (z direction). On each of the four electrode rods are formed crest and trough portions in the lengthwise direction, and the electrodes are oriented such that the crest portions of a pair of electrodes, for example, electrodes A and C, correspond to the trough portions of the adjacent other pair of electrodes B and D, and that the trough portions of the pair of electrodes A and C correspond to the crest portions of the other pair of electrodes B and D. By inducing a radio-frequency voltage between each pair of electrodes A and C and the electrodes B and D, an accelerating electric field is generated in the beam propagation direction and a converging electric field is generated in a direction perpendicular to the beam propagation direction. A period between the crest and the trough of the electrode is called a cell.

Then, the time w/v in which ions travel over a distance w of a cell is set to be equal to a half-period T/2 of the radio-frequency. Namely, when the wavelength of the radio-frequency is $\lambda$, the distance $w=vT/2=(v/c)\ (cT/2)=\beta\lambda/2$. When the distance between adjacent crests is determined in this manner, ions pass through a cell per alternation of the accelerating electric field in the z direction. Thus, ions are accelerated by being subjected to electric field per cell. The RFQ accelerator functions as a linear accelerator because the propagation of ions and the alternation of the radio-frequency are synchronized in this manner. As ions are accelerated, v increases, and accordingly $\beta=v/c$ is also increased. Thus, the electrodes are designed such that the cell length increases progressively by small increments along the lengthwise direction of the electrodes.

As described above, the RFQ accelerator accelerates ions under the principle that is completely different from that of the conventional linear accelerator in which ions are accelerated linearly by application of a DC high voltage between electrodes which are separated from one another in the beam propagation direction. Thus, even through the RFQ accelerator is categorized as a linear accelerator by the fact that ions are accelerated in a straight line trajectory, the RFQ accelerator is largely different from the conventional linear accelerator in the arrangement of the electrodes and in the acceleration voltage, for which radio-frequency is used instead of direct current.

The RFQ accelerator has various advantages. First, it is not required to provide a large power source of a DC high voltage, instead a small radio-frequency power source is provided, thus reducing the volume of the power source section.

Secondly, the dimensions of the acceleration tube can be made compact. The cell length of the four electrodes is very small, and beam bore radius $R_1$ is 4 mm. Thus, because the gap between the electrodes is narrow and the dimension in a direction perpendicular to the beam propagation direction is small, the cylindrical vacuum chamber surrounding the electrodes can be made sufficiently compact with a diameter of, for example, 600 mm. Further, the length in the direction of beam axis can be made short. For example, the length of the chamber is from 1 m to 3 m.

Thus, the RFQ accelerator is highly appealing in view of the power source requirement and the size of a vacuum chamber, and unlike the conventional linear accelerator of DC type, has a potential of realizing a practical accelerator in an industrial setting, such as manufacturing of semiconductors.

In the RFQ accelerator having the described arrangement, the present invention concerns the configuration of the four RFQ electrodes of A, B, C, and D, and their proportional relations to one another. The electrodes A, B, C, and D are provided extending in the beam propagation direction, and are rods each having crest and trough portions which are 180° off-phase between adjacent electrodes (A and B, B and C, C and D, and D and A). Several points on the electrodes A, B, C, and D are supported by components called posts.

Posts provide a mechanical support of the electrodes A, B, C, and D to the inner wall of a tank (vacuum chamber), and form a resonance circuit in the tank. The electrodes A, B, C, and D and the posts generate a large amount of heat as a result of a large amount of radio-frequency current flowing on them. Thus, the electrodes A, B, C, and D are made of material having high electric and thermal conductivity, and a coolant is flown therein. In order to allow sufficient flow of a coolant, a coolant channel having a sufficient cross sectional area is required.

In the early stage of RFQ development, the ion beam had been accelerated in a low duty mode because of the heat problem. The duty is defined as the ratio of the time in which the ion beam is accelerated to a period of radio frequency. However, there has been a strong demand for an ion beam of large current, and there is a need to increase a duty. To realize this in an RFQ, a continuous wave (Cw) operation by means of increased cooling efficiency is needed.

An RFQ electrode which was first manufactured is a round rod having a waveform, as shown in FIG. 1. Since four rod electrodes provided are the same, the structure of only one electrode is shown. The entire periphery of a metal rod (copper, or alminium or iron plated with copper) having a circular cross sectional area is machined to have a waveform which is determined by the type of accelerating ion, input ion energy, output energy, and other factors, and a cavity for allowing a coolant to flow is provided inside the metal rod. It is possible alternatively to form a waveform by machining a metal material which has already been provided with a cavity. Such a waveform can be formed with ease, for example, by rotating a round rod, which is axially symmetrical, on a lathe. This technique has an advantage that the manufacturing is easy. Also, since the rod is axially symmetrical, it can be mounted on a post with ease for direction is not of concern.

As described, the early RFQ electrodes were solely for research purposes in laboratories and were for accelerating an ion beam of small current with low duty in a pulse operating mode. Accordingly, only a small amount of coolant was required. However, when it comes to high duty operation, the coolant channel of the electrode of FIG. 1 is too narrow to be applied for such a purpose, arising from the fact that the coolant cavity cannot be increased. Also, since the round rod is shaped into a waveform, the waist trough portions are weak and susceptible to bending. Further, mechanical oscillation is induced by the flow of a coolant. In particular, when oscillation is generated in the diagonal line directions, the electric fields are disturbed, and this might cause a problem in the quality of the accelerated beam. There is also a case where the beam collides with the electrodes, damaging and wearing the electrodes.

In order to solve these problems, an RFQ electrode as shown in FIG. 2 was invented. This RFQ electrode has a structure wherein a cavity is provided as a coolant channel inside a rectangular bar made of copper, or iron or alminium plated with copper, and a waveform with crest and trough portions is formed only on a surface facing the beam passage spacing. This RFQ electrode is the previous invention of the inventor of the present application. The crest and trough portions are provided only on one side of the electrode because an electric field wave is required only in the vicinity of the central axis of the beam. This allows the diameter of the coolant channel to be increased. Further, since a rectangular bar is adopted, the electrode is rigid in the height direction, and is resistant to bending. This electrode realizes ion beam acceleration with considerably high duty.

When a gap between electrodes is narrow, it is difficult to introduce an ion beam therebetween. The measure of how easily an ion beam is introduced between the electrodes is called acceptance. When the gap between the electrodes is, for example, 8 mm, it can be said that the acceptance is relatively large.

The following deals with height H of the electrode. The height H of the electrode is defined as the distance from a crest of one electrode to a bottom surface on the opposite side of the same electrode. In the case of RFQ electrodes to which a radio-frequency of 100 MHz is applied for acceleration of $He^+$ ion, an electrode height H of 21 mm has been adopted conventionally. This is not without a problem. When the radio-frequency is increased, the cell length ($\beta\lambda/2$) is reduced, and accordingly optimum electrode height H is reduced proportionally. Thus, an optimum value of height H should be defined in relation to the frequency.

The RFQ electrode of FIG. 2 has a uniform waveform in the beam propagation direction, and is to be fixed to a supporting component (posts) by blazing. FIG. 3 shows a schematic arrangement of such an RFQ linear accelerator. On a position corresponding to four vertices of a square, electrodes A, B, C, and D are placed. Two kinds of posts are provided as vertical plates: One connected to the electrodes A and C, and one connected to the electrodes B and D. A long plate extending along the beam propagation direction, vertically supporting the posts, is a base. The electrodes, the posts, and the base constitute a radio-frequency resonance structure.

Although not shown, a coolant pipe is provided in the vicinity of the base and the posts. Also not shown are waveforms formed on the facing surfaces of the electrodes. In reality, the posts and the base are surrounded by a cylindrical vacuum chamber. Though it is desirable that the vacuum chamber is reduced as much as possible in view of the costs and space, a vacuum chamber that is too small lowers the power efficiency.

From a view of the above conventional problems, it is an object of the present invention to provide an RFQ accelerator, whose partial or entire configuration of RFQ electrodes is optimized, having desirable power efficiency, high acceptance for smooth introduction of an ion beam, superior mechanical strength, and desirable cooling efficiency, and to provide an ion implanter provided with such an RFQ accelerator.

DISCLOSURE OF INVENTION

An RFQ accelerator in accordance with claim 1 invention is characterized in that four electrodes extending in a beam acceleration direction are positioned at 90° angle to one another in a cylindrical vacuum chamber, each pair of the four electrodes on a diagonal line being connected to posts, adjacent electrodes of the four electrodes facing each other on a crest portion and a trough portion formed on an electrode surface, the RFQ accelerator accelerating an ion beam guided to a beam passage spacing surrounded by the four electrodes by radio-frequency electric fields induced between adjacent electrodes, wherein a radius $R_1$ of the beam passage spacing surrounded by the four electrodes is selected from a range of 5 mm to 9 mm, a curvature $R_2$ of the crest portion in a direction perpendicular to an axis of the four electrodes is selected from a range of 5 mm to 9 mm, and a height H from a crest portion to a bottom surface is selected so that a ratio of $H/R_1$ is in a range of 4 to 6.

In general, in an RFQ accelerator, when the electrode height H is reduced, shunt impedance increases and the power efficiency is improved. Yet, because the cross section of the coolant channel cannot be increased, problems are likely to occur that cooling ability becomes insufficient, and the mechanical strength suffers, causing the electrodes to oscillate. However, with the described arrangement, it is possible to realize an optimum configuration of the RFQ electrodes in which, with respect to a low resonance frequency of 25 MHz to 50 MHz suitable for heavy ions such as B, P, and As, power efficiency is high, cooling ability is superior, mechanical strength is sufficient, and beam acceptance is large.

An RFQ accelerator in accordance with claim 2 invention is characterized in that each of the four electrodes has partial expanded portions on the bottom surface, the expanded portions being provided with bolt holes, side surfaces of the expanded portions brought into contact with the posts so that each of the four electrodes is fixed to the posts by bolts.

With this arrangement, because the electrodes are fixed to the posts by bolts through screw holes with a direct contact, it is possible to improve electric and thermal conductance.

An RFQ accelerator in accordance with claim 3 invention is characterized in that each of the four electrodes has a substantially pentagonal cross section perpendicular to the axis, the electrode surface, which meets the beam passage spacing, being composed of circular arc forming the crest portion or the trough portion and inclined linear surfaces continuing from the circular arc.

With this arrangement, because the entire electrode surface meeting the beam passage spacing is composed of a combination of circular arc and line, instead of circular arc alone, it is possible to machine the electrodes with ease.

An RFQ accelerator in accordance with claim 4 invention is characterized in that each of the four electrodes is provided with a coolant channel in the beam propagation direction, the coolant channel being a cavity machined inside the each of the four electrodes by a gun drill, etc.

With this arrangement, compared with the case where the coolant channel is provided by blazing a copper pipe to a vane electrode, it is possible to reduce distortion on the electrode due to the heat generated in the machining process and improve the cooling efficiency.

An RFQ accelerator in accordance with claim 5 invention is characterized in that the posts for supporting the four electrodes are positioned so that intervals between adjacent posts are equal on one side of the four electrodes.

With this arrangement, because the posts partially constituting an RFQ resonance circuit are disposed at equal intervals on one side of an acceleration tube, it is possible to minimize the resonance frequency of the RFQ while maintaining simple assemblage.

An ion implanter in accordance with claim 6 invention is characterized by including: an ion source for generating ions; an extraction electrode for drawing ions by accelerating ions generated in the ion source to a predetermined initial energy; an analyzer electromagnet for extracting only desired ions from the ions drawn by the extraction electrode; a focusing lens system for focusing ions from the analyzer electromagnet to have a beam diameter suitable for acceleration; an RFQ accelerator as defined in any one of claims 1 through 5 for accelerating ions from the focusing lens system to a desired energy so as to irradiate the ions on or implant the ions in a target; and an acceleration-deceleration system, provided as required on a following stage of the RFQ accelerator, for further accelerating or decelerating the ions.

With this arrangement, it is possible to realize a high energy ion implanter in the order of several MeV and a large current high energy ion irradiating device in a size and cost that are compact and low enough to be applied in an industrial setting such as in semiconductor industry.

PREFERRED EMBODIMENTS OF THE PRESENT INVENTION

In order to achieve the above-mentioned object, the present invention finds and optimizes parameters for improving the power efficiency of RFQ electrodes using three-dimensional dynamic electromagnetic field analysis code, taking into consideration cooling ability, mechanical strength, and assemblage simplicity, etc.

Figure 1:
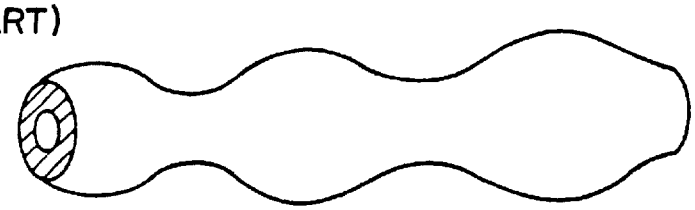
FIG. 1 (PRIOR ART)
FIG. 1 is a perspective view schematically showing an earliest RFQ electrode, which is most typical of the prior art, having a structure wherein a waveform is formed on a pipe having a circular cross section with a cavity in a beam propagation direction so that the waveform is symmetrical around a revolution axis.
Figure 2:
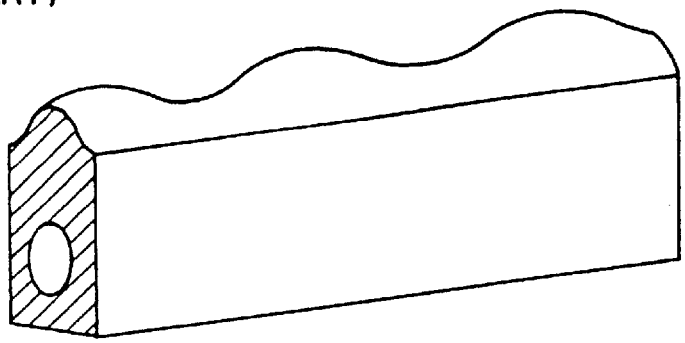
FIG. 2 (PRIOR ART)
FIG. 2 is a perspective view schematically showing another conventional RFQ electrode having a structure wherein a coolant channel is provided in a lengthwise direction inside a metal rod having a rectangular cross section and a waveform of alternating crest and trough portions is provided on a surface meeting a beam passage spacing.
Figure 3:
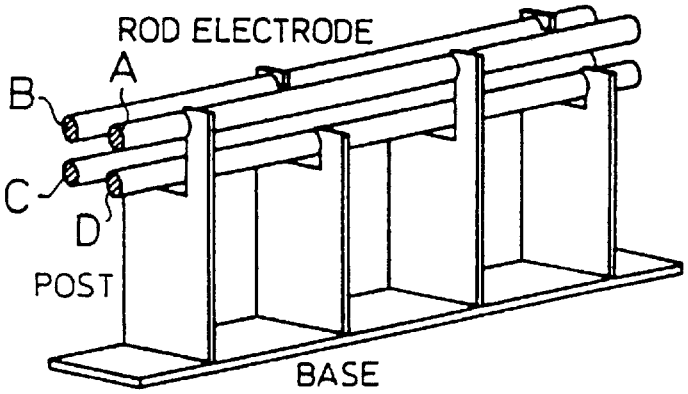
FIG. 3 (PRIOR ART)
FIG. 3 is a schematic perspective view of an RFQ linear accelerator.
Figure 4:
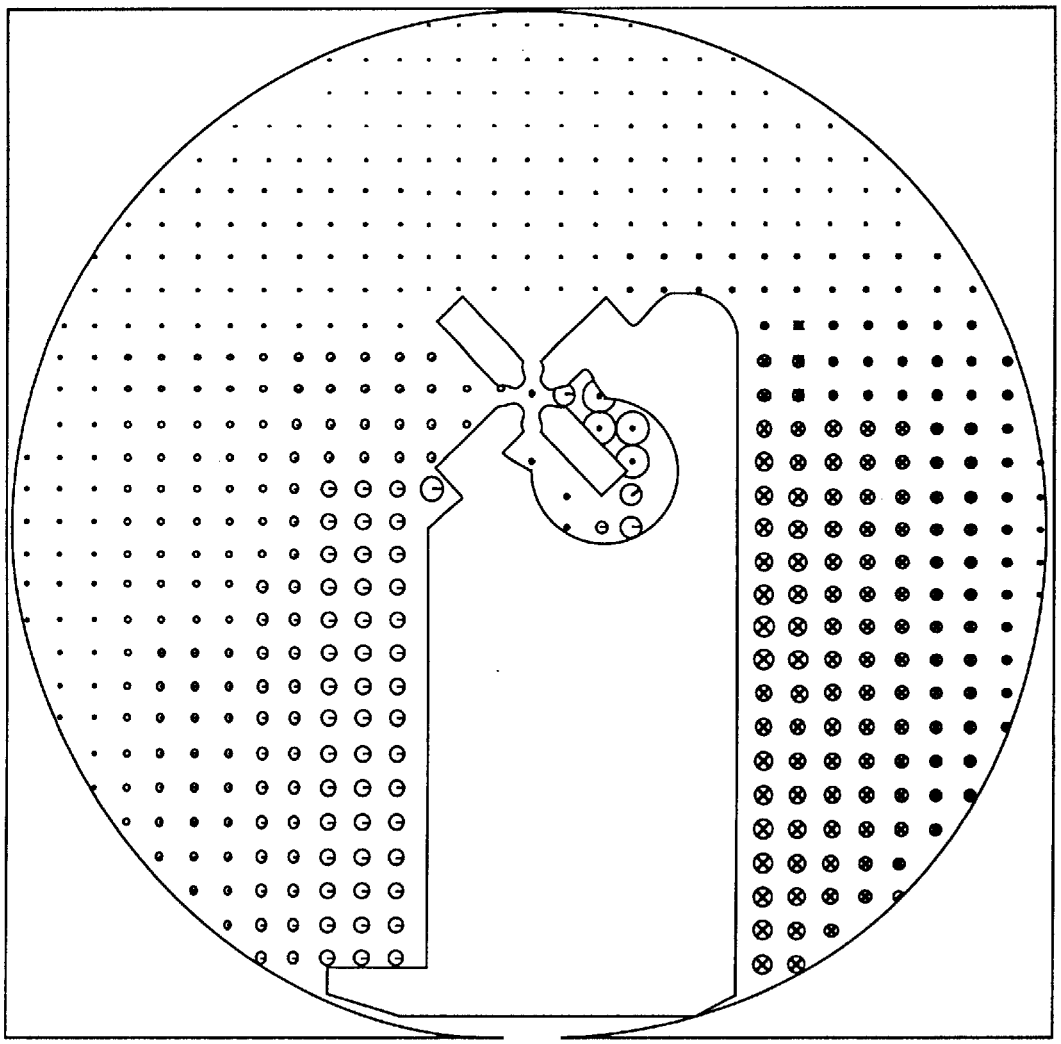
FIG. 4 is a projection view showing a result of simulation by three-dimensional dynamic electromagnetic field analysis code conducted on an RFQ accelerator.

FIG. 4 shows a projection of an RFQ accelerator employing RFQ electrodes of the present invention. A large circle indicates the size of a vacuum chamber. Inside the vacuum chamber are installed the RFQ electrodes, posts, and a base. The shadow on the center resembling four petals of a flower is a projection of the RFQ electrodes. A rectangular plate with an inclined surface is a projection of one of two kinds of the posts. It is clearly depicted how a pair of electrodes on a diagonal line are connected to the post.

In FIG. 4, a space is divided into a vertical and horizontal array of lattices at regular intervals, and the strength of magnetic field is shown at each lattice point. The arrow indicates the direction of the magnetic field, and the size of the circle indicates the magnitude of the magnetic field. The symbol "x" indicates the direction of the magnetic field into the plane of the paper. Because a large current flows through the post, a strong magnetic field is generated around the post. The magnetic field on the cross section of the post is weak on the upper portion and strong on the lower portion. The magnetic field is also strong in the vicinity of the vacuum chamber on the lower portion. An electric field is generated in a direction orthogonal to this magnetic field, and the electric field induces a radio-frequency current on the vacuum chamber. Therefore, the vacuum chamber cannot be reduced much.

Figure 5:
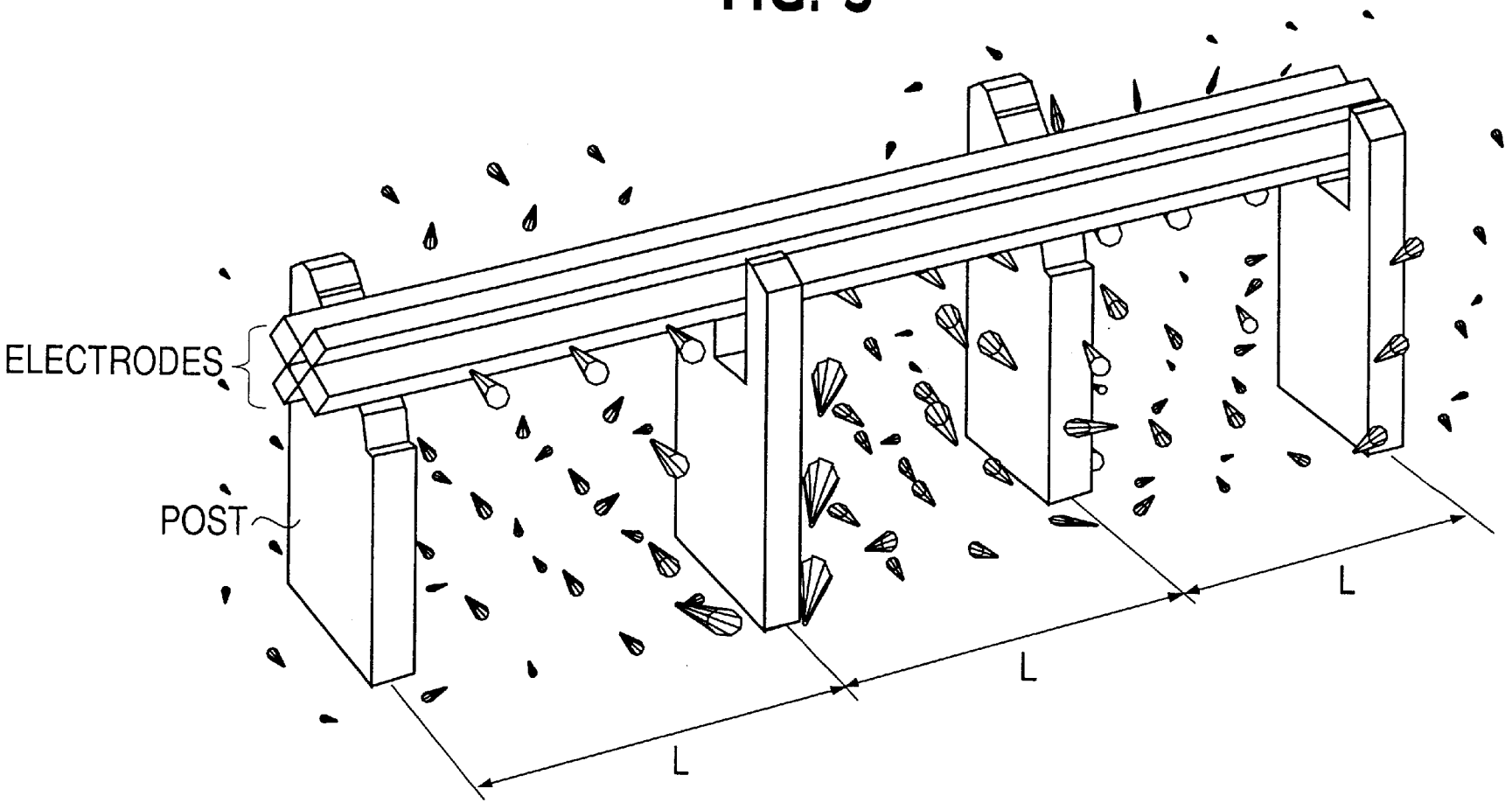
FIG. 5 is a drawing showing a result of simulation by three-dimensional dynamic electromagnetic field analysis code conducted on an RFQ accelerator having a structure wherein RFQ electrodes are supported by four posts.

FIG. 5 shows the result of calculation by three-dimensional dynamic electromagnetic field analysis code in different representation. Shown are the RFQ electrodes and the posts for supporting pairs of electrodes on diagonal lines. The base and the vacuum chamber are omitted. The magnitude and direction of the magnetic field are denoted by cones. The cones represent the magnitude and direction of the magnetic field at one instance when an acceleration tube is oscillated in an RFQ mode with a frequency of 101 MHz. In the RFQ mode, a magnetic field is generated around each post, the direction of the magnetic field being opposite between adjacent posts. The magnitude of the magnetic field is different depending on how the posts are arranged. Posts adjacent to each other constitute a unit.

In the RFQ accelerator adopted in the present invention, as shown in FIG. 5, a single acceleration tube is composed of three units, and the posts are disposed on one side of the RFQ electrodes, and intervals L between adjacent posts are the same. In this arrangement, the pattern of the magnetic field remains the same even when the radio-frequency is changed. However, the cell length and the optimum electrode dimensions differ depending on the types of ions and the frequency. The posts partially constituting an RFQ resonance circuit are disposed at equal intervals on one side of the electrodes, minimizing the resonance frequency of the RFQ while maintaining simple assemblage.

Figure 6:
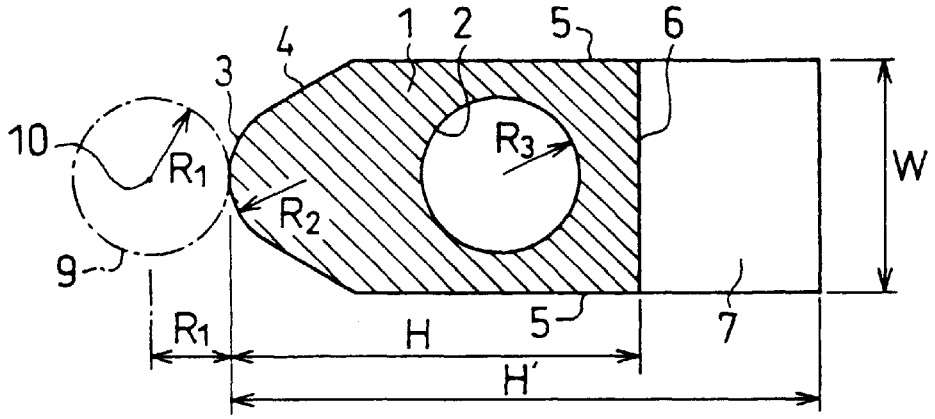
FIG. 6 is a cross sectional view of an RFQ electrode in accordance with the present invention, taken along a direction perpendicular to an axis thereof.
Figure 7:
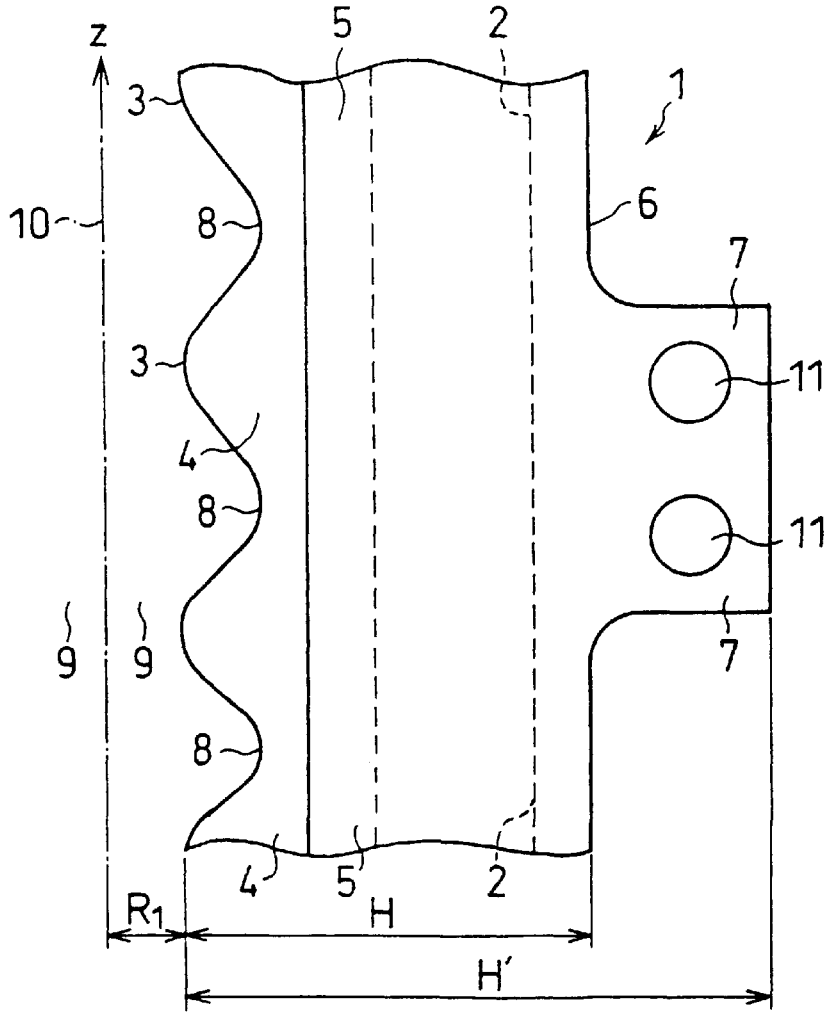
FIG. 7 is a partial side surface view of the RFQ electrodes in accordance with the present invention.

FIG. 6 and FIG. 7 explain configuration parameters of the RFQ electrodes of the present invention. FIG. 6 is a cross section of an RFQ electrode 1, taken along a line perpendicular to the axis. FIG. 7 is a side view showing a portion of the RFQ electrode 1. The RFQ electrode 1 is a metal rod having high electric and thermal conductivity, such as copper and alminium, extending in the beam propagation direction (z direction), and the cross section taken along a line perpendicular to the axis is a near pentagon, and provided along the beam propagation direction is a coolant channel 2 having a radius of $R_3$.

The coolant channel 2 may be provided by blazing a copper pipe to vane-shaped RFQ electrode 1. However, as above, when the coolant channel 2 is provided by directly machining the RFQ electrode 1 using a gun drill, etc., it is possible to reduce distortion on the electrode due to the heat generated in the machining process and improve the cooling efficiency.

In the vicinity of a beam passage spacing 9 is provided an waveform edge of alternating crest portion 3 and trough portion 8 in the beam propagation direction. The crest portion 3 and the trough portion 8 extend into inclined surfaces 4 of 60°, which continue to side surfaces 5. Therefore, the surface facing the beam passage spacing 9 has components of circular arc and line, instead of circular arc alone, allowing easy machining of the electrodes. Orthogonal to the side surfaces 5 parallel to each other is a bottom surface 6. FIG. 6 is a cross section taken along a line perpendicular to an axis 10 (z axis) in which a beam passes through. Not shown in FIG. 6 are crest portions of the other three electrodes, which are actually facing the crest portion 3.

A circle indicated by the alternate long and short line is the beam passage spacing 9, and the crest portions of the other electrodes are positioned where the beam passage spacing 9 extending in the z direction intersects with the orthogonal axes X and Y. When the electrodes of one pair are facing each other on the crest portions, the electrodes of the other pair are facing each other on the trough portions. Thus, the spacing surrounded by the four electrodes is not a circle. Nevertheless, the beam passage spacing 9 is defined as an inscribed circle of the four crest portions. Radius $R_1$ of the inscribed circle defines the radius of the beam passage spacing 9.

Provided that the other structure is the same, narrower beam passage spacing 9 results in higher electric field, and desirable power efficiency is obtained. However, it is difficult to introduce a beam, from an ion source through a mass spectrometer magnet, into the beam passage spacing 9. As mentioned above, acceptance is the measure of how easily a beam is introduced. When the inscribed circle radius $R_1$ is small, the acceptance is small, and when the inscribed circle radius $R_1$ is large, the acceptance is large. $R_2$ is the curvature radius of the crest portion of the electrode in a direction perpendicular to the axis, and $R_3$ is the radius of the coolant channel 2.

The width of the RFQ electrode 1, that is, a distance between the side surfaces 5 parallel to each other is W. The distance between the peak of the crest portion to the bottom surface is electrode height H. Electrode height H is related to shunt impedance, which will be described later. The RFQ electrodes of the present invention are provided with a number of protrusions on the bottom surfaces, each as a mount section 7, and therefore are not uniform in the beam propagation direction. H' is the distance from the peak of the crest portion to the bottom of the mount section 7. The mount section 7 is provided with bolt holes 11. The RFQ electrode 1 is directly fixed to screw holes of the post by bolts. Because the side surface of the mount section 7 of the RFQ electrode 1 is in direct contact with the post, desirable electric and thermal conductance is obtained.

An optimum RFQ configuration is determined using these parameters with a consideration of several conditions. First, it is desirable that an ion beam is accelerated with a minimum amount of power. It is the gist of the present invention to reduce a power loss by taking an advantage of the fact that the power consumption is related to the electrode height H. The degree by which the power consumption and the electrode height H are related to each other and how much power is required for obtaining a required voltage are determined by shunt impedance.

Figure 8:
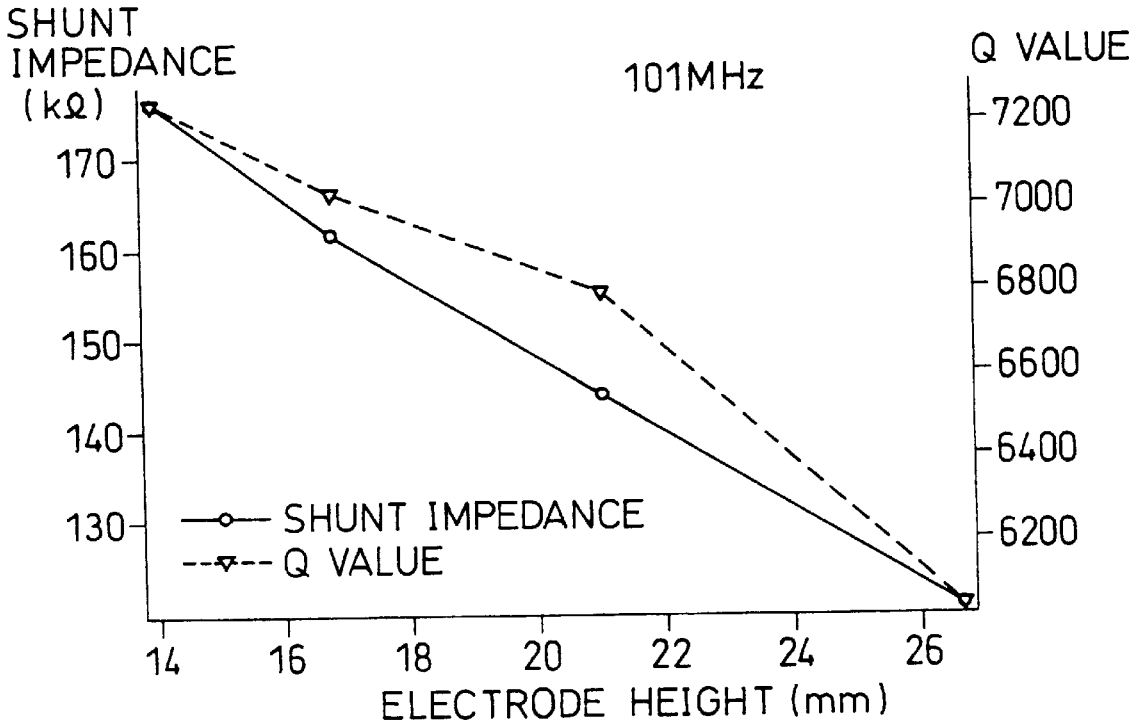
FIG. 8 is a drawing showing a simulation result of height H of the RFQ electrodes with respect to shunt impedance and Q value of the RFQ accelerator operating with an applied radio-frequency of 101 MHz.

FIG. 8 is a plot of (i) shunt impedance (indicating efficiency of generating a voltage between electrodes with respect to the input power) with respect to electrode height H when an accelerating electric field is generated between the RFQ electrodes by a radio-frequency of 101 MHz and (ii) Q value (inversely proportional to the power loss of acceleration tube). The simulation was conducted at four points, other data were obtained by interpolation.

When the electrode height H is 27 mm, the shunt impedance is 120 kΩ and the Q value is 6000. When the electrode height H is 21 mm, the shunt impedance is 144 kΩ and the Q value is 6800. When the electrode height H is 17 mm, the shunt impedance is 162 kΩ and the Q value is 7050. When the electrode height H is 14 mm, the shunt impedance is 176 kΩ and the Q value is 7200. It can be seen from FIG. 8 that, in general, as the electrode height H decreases, the shunt impedance and the Q value are both increased. Namely, the power efficiency of the acceleration tube is increased as an inverse of the electrode height H. This effect is a result of reduced capacitance between the electrodes and resulting improved Q value.

When the radio-frequency applied to the RFQ electrodes is 101 MHz as above, an electrode height H of 21 mm had been adopted conventionally. The inventor of the present invention speculated that the power loss could be reduced when the electrode height H was reduced to 14 mm. In such a case, compared with the shunt impedance of 144 kΩ at H=21 mm, the shunt impedance was 176 kΩ at H=14 mm, thus increasing the shunt impedance by substantially 22 percent. The input power can be reduced in accordance with the shunt impedance.

The shunt impedance and the input power have the following relation:

$$\text{shunt impedance}=(\text{voltage between electrodes})^2/(2\cdot\text{input power})$$

Therefore, provided that the voltage applied between the electrodes is the same, the shunt impedance is inversely proportional to the input power. As described, when the shunt impedance is increased 1.22 times, the power required for obtaining the same voltage is only 0.82 times the power which would have been required. Thus, by reducing the electrode height H to 14 mm, compared with the conventional case (H=21 mm), the same voltage can be generated between the electrodes with 82 of the power.

The electrode height H of 14 mm is suitable when the radio-frequency voltage applied is 101 MHz, and because a suitable electrode height H is inversely proportional to the frequency, in the case where the radio-frequency is different, the above equation gives a direction in finding a suitable electrode height H. Light ions such as $He^+$ can be accelerated with high frequency as above. However, to accelerate a heavy ion such as $B^+$, lower frequency is used. For example, in the case of accelerating $B^+$ ions, a radio-frequency of 25 to 50 MHz is used, which is around one third of the above radio-frequency of 101 MHz.

When the optimum electrode height is 14 mm at the frequency of 101 MHz, from a view point of power consumption, at the radio-frequency of 33 MHz, the optimum electrode height H is 42 mm, which is three times the optimum electrode height of 14 mm at the frequency of 101 MHz. The electrode height of 42 mm provides sufficient mechanical strength, and allows the electrodes to be mounted on posts without a problem.

The RFQ accelerator of the present invention has it as a premise to be applied to a high energy ion implanter for implanting heavy ions such as B, P, and As as a dopant in manufacturing of Si semiconductors, and for this reason relatively low radio-frequency is chosen. Thus, acceleration by the RFQ accelerator of the present invention is largely different from acceleration of ions such as $He^+$, which has been carried out in research laboratories.

The following concerns a spacing in which a beam passes through, that is, the distance between the crest portions of facing electrodes. The beam passage spacing is defined by the radius $R_1$ of the inscribed circle, and has a diameter of $2R_1$. Because a strong electric field is generated in the beam propagation direction (z direction), the diameter of $2R_1$=8 mm has been adopted conventionally. While this provides desirable power efficiency, the acceptance is small. In other words, the emittance of the ion beam from the ion source via a mass spectrometer magnet is larger than the acceptance of the RFQ electrodes. For this reason, in the present invention, the diameter is doubled so that $2R_1$=16 mm.

The curvature of the crest portion of the electrode in the x direction (curvature on the cross section perpendicular to the lengthwise direction) is also a concern. The curvature is defined by the curvature radius $R_2$, which is a reciprocal of the curvature. When the curvature radius $R_2$ is large, while desirable acceptance is obtained, the power efficiency suffers. When the curvature radius $R_2$ is small, the acceptance suffers but desirable power efficiency is obtained. The optimum values of $R_1$ and $R_2$, from a view point of acceptance and power efficiency, are both in a range of 5 mm to 9 mm, as shown in Table 1. This is for acceleration of heavy ions such as B, P, and As.

TABLE 1

RANGE OF RADIUS $R_1$ OF BEAM PASSAGE SPACING AND CURVATURE RADIUS $R_2$ OF CREST PORTION OF ELECTRODE AND EVALUATION OF ACCEPTANCE AND POWER EFFICIENCY

| $R_1$ and $R_2$ | <5 mm | 5 mm to 9 mm | >9 mm |
|---|---|---|---|
| Acceptance | x | ○ | ◎ |
| Power Efficiency | ◎ | ○ | x |
| Evaluation | 1 | 2 | 1 |

As mentioned above, an electrode height H of 14 mm is desirable at the frequency of 101 MHz. Here, electrode height H is a function of frequency, and this presents some ambiguity. Therefore, a range of optimum electrode height H is defined as multiples of the radius $R_1$ of the beam passage spacing. As shown in Table 2, it is desirable that the ratio of $H/R_1$ is in a range of 4 to 6, and the optimum value is 5. The ratio below this range results in lower mechanical strength and poor cooling ability. When the ratio exceeds this range, the power efficiency suffers. Thus, overall evaluation shows that the ratio $H/R_1$ in a range of 4 to 6 is preferable.

TABLE 2

RANGE OF RATIO $H/R_1$ OF ELECTRODE HEIGHT H TO RADIUS $R_1$ OF BEAM PASSAGE SPACING AND EVALUATION OF COOLING ABILITY, POWER EFFICIENCY, AND MECHANICAL STRENGTH

| $H/R_1$ | <4 | 4 TO 6 | >6 |
|---|---|---|---|
| Cooling Ability | x | ○ | ◎ |
| Power Efficiency | ◎ | ○ | x |
| Mechanical Strength | x | ○ | ○ |

TABLE 2-continued

| RANGE OF RATIO $H/R_1$ OF ELECTRODE HEIGHT H TO RADIUS $R_1$ OF BEAM PASSAGE SPACING AND EVALUATION OF COOLING ABILITY, POWER EFFICIENCY, AND MECHANICAL STRENGTH | | | |
|---|---|---|---|
| $H/R_1$ | <4 | 4 TO 6 | >6 |
| Evaluation | 0 | 3 | 2 |

As shown above, $R_1$ and $R_2$ in a range of 5 mm to 9 mm and $H/R_1$ in a range of 4 to 6 have the highest points in overall evaluation.

The following describes design values of the most preferable embodiment. In a simulation model for determining the design values, the radio-frequency was set to 100 MHz. To accelerate such ions as B and P, which are commonly used as a dopant of a semiconductor, as mentioned before, it is required to operate the accelerator with a frequency in a range of 25 MHz to 50 MHz. The parameters of electrodes are as shown in FIG. 6 and FIG. 7.

Shown below are optimum RFQ electrode dimensions when operating the accelerator with the above frequency range.

$R_1$=8 mm
$R_2$=8 mm
$R_3$=8 mm
W=24 mm
H=42 mm

When the electrode height H is reduced, while the shunt impedance is increased, due to the fact that the cross section of the coolant channel cannot be increased, the cooling ability becomes insufficient. Further, the mechanical strength also becomes insufficient and oscillation of electrodes is likely to occur. In practice, as shown above, it is preferable that the electrode height H is substantially 5 times the radius $R_1$ of the beam passage spacing. This allows large shunt impedance without losing the cooling ability.

Also, as described, the RFQ electrode is not uniform in shape and has protrusions on the bottom portion to be mounted on the posts. The electrode has a local height H' at the mount section 7, where H' >H. The mount section 7 is provided with the bolt holes 11, and is fixed to the post by bolts. Therefore, a side surface of a portion of the electrode is in direct contact with the post, ensuring close contact with the post, both electrically and mechanically. This arrangement is also advantageous from a view point of heat radiation.

Figure 9:
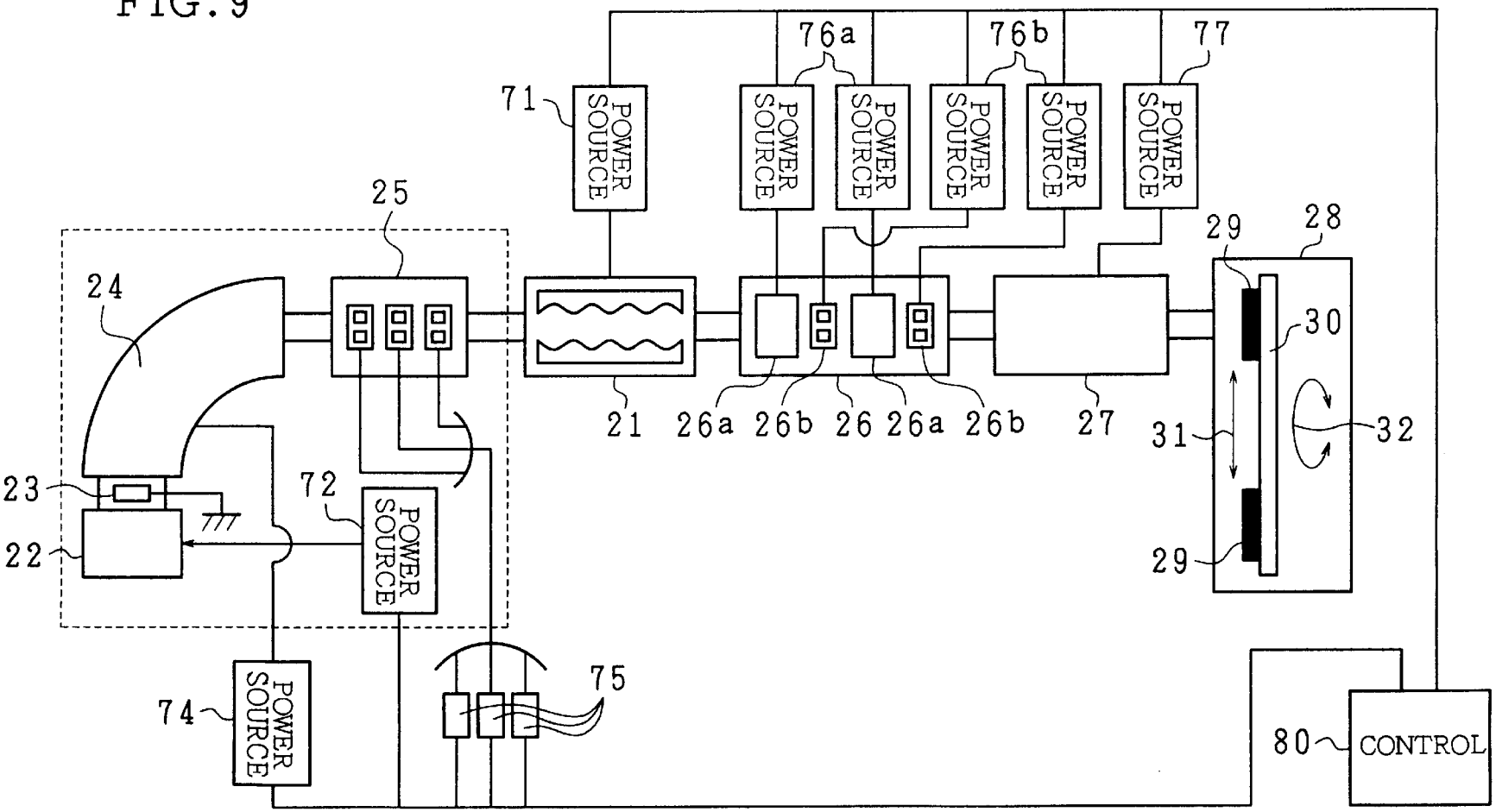
FIG. 9 is a plan view schematically showing one arrangement of an ion implanter adopting the RFQ accelerator in accordance with the present invention.

FIG. 9 is a plan view schematically showing one arrangement of an ion implanter adopting an RFQ accelerator 21, which has been made by selecting the parameters in the described manner, in accordance with the present invention. In an ion source 22, plasma is generated from a gaseous or solid reagent, and ions are drawn from the ion source 22 by an extraction electrode 23. From the ions which were accelerated to a predetermined initial energy by the extraction electrode 23, only desired ions, such as B, P, and As, are extracted by an analyzer electromagnet 24, and the ions thus extracted are incident on the RFQ accelerator 21 in accordance with the present invention after focused by a focusing lens system 25. The focusing lens system 25 is composed of a single or plurality (three in FIG. 9) of quadrupoles of electromagnet type, electrostatic type, or permanent magnet type, and converges a beam diameter to a diameter of not more than $2R_1$ so that the ions from the analyzer electromagnet 24 are accelerated efficiently by the RFQ accelerator 21.

The ion beam incident on the RFQ accelerator 21 is bunched in the beam propagation direction in the front-half of the RFQ accelerator 21 and is accelerated to a desired energy in the end-half of the RFQ accelerator 21. In the case where the RFQ accelerator 21 fails to provide sufficient acceleration energy, an acceleration-deceleration system 26 is provided on the next stage. The acceleration-deceleration system 26 is composed of a combination of the RFQ electrodes, a radio-frequency acceleration tube having an acceleration gap of one or more stages, and a quadrupole beam focusing lens system, or composed of a combination of a radio-frequency acceleration tube of gap type and a focusing lens system, or composed of other combinations. In the example of FIG. 9, the acceleration-deceleration system 26 is composed of a radio-frequency acceleration tube 26*a* and a quadrupole beam focusing lens 26*b*, each provided in two stages.

The ions which have been accelerated to a desired energy suitable for implantation or irradiation are guided, after the ion energy is separated out in an energy analyzer 27, to an irradiation room 28 so as to be irradiated on or implanted in a working target 29. The energy analyzer 27 may be excluded depending on the use, as with the acceleration-deceleration system 26. In the irradiation room 28, the working target 29, such as semiconductor wafers, is placed on a disk 30, and the disk 30 is moved in a direction of an arrow 31 and rotated in a direction of an arrow 32 on a plane perpendicular to the beam propagation axis, thereby realizing uniform ion irradiation or ion implantation as well as total or successive processing of the working target 29.

Figure 10:
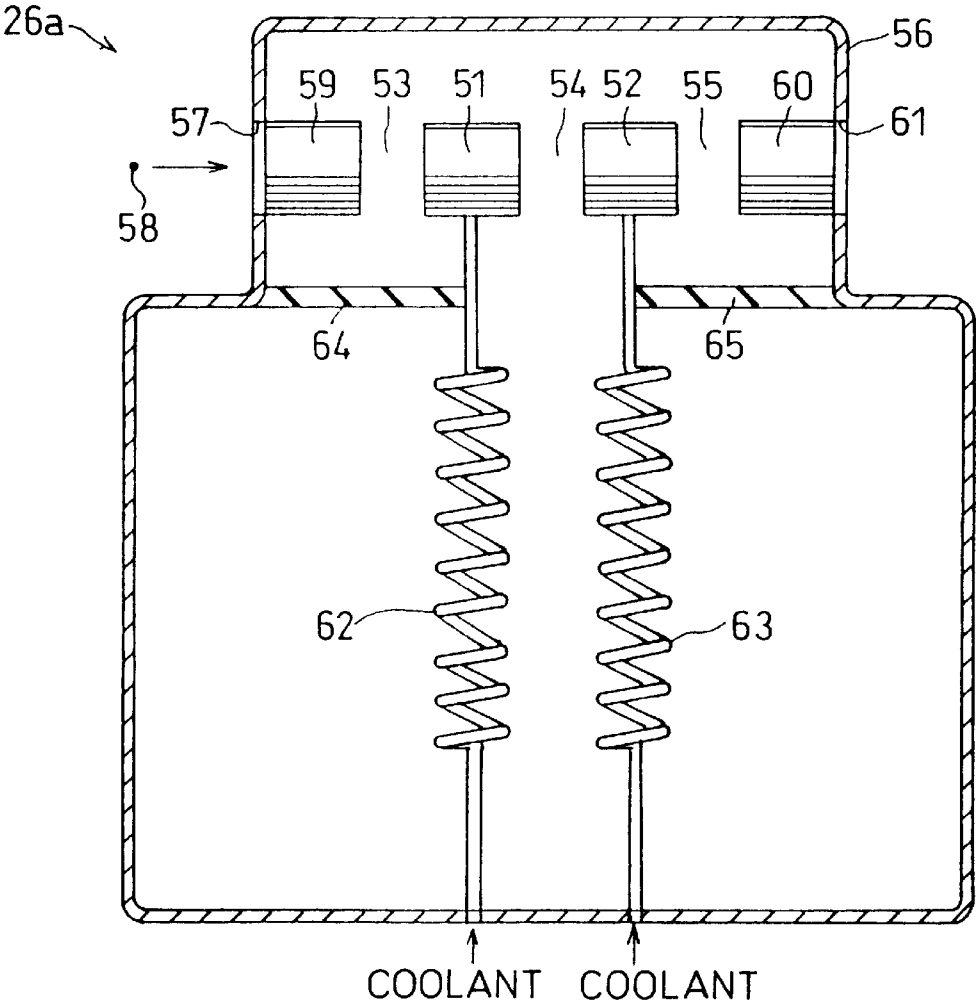
FIG. 10 is a vertical cross sectional view showing one arrangement of an acceleration tube of an acceleration-deceleration system provided on a following stage of the RFQ accelerator of the ion implanter of FIG. 9

FIG. 10 is a cross sectional view, taken along a vertical line, of one arrangement of the radio-frequency acceleration tube 26*a* of the acceleration-deceleration system 26 provided on the following stage of the RFQ accelerator 21 in the ion implanter of FIG. 9. The radio-frequency acceleration tube 26*a* is provided with two electrodes 51 and 52, namely, three acceleration gaps 53, 54, and 55 are provided. An ion 58 incident on a hole 57 formed on a tank 56 is accelerated sequentially in its way through (1) the acceleration gap 53 between a ground electrode 59 of a ground potential connected to the tank 56 and the electrode 51 applied with a radio-frequency voltage, (2) the acceleration gap 54 between the electrode 51 and the electrode 52, and (3) the acceleration gap 55 between the electrode 52 and a ground electrode 60, so as to be accelerated through a hole 61. The electrodes 51 and 52 are respectively connected to resonance inductors 62 and 63 in which a radio-frequency voltage is generated by a power source.

The inductors 62 and 63 constitute, for example, a $\lambda/4$ resonator with respect to a certain frequency of an operation frequency in a range of 25 MHz to 50 MHz when the ion 58 is B or P. Because higher power efficiency is obtained with smaller diameter of the inductors 62 and 63 with respect to the inner diameter of the tank 56, and to reduce the size of the acceleration tube 26*a*, the inductors 62 and 63 are provided helically in the form of coils. Also, the inductors 62 and 63, which consume a large amount of radio-frequency power delivered, have a concentric cylindrical structure, and a coolant from outside circulates inside the cylinders. For this reason, the inductors 62 and 63 are mechanically unstable, and in order to suppress a change in resonance frequency due to oscillation, respective one ends of the inductors 62 and 63, which are free ends on the other side of the inductors 62 and 63 fixed to the bottom of the tank 56, directing towards the electrodes 51 and 52 are fixed to the inner wall of the tank 56 by insulating plates 64 and 65, respectively.

Power sources 72, 74, 75, 71, 76, and 77 are provided, respectively corresponding to the ion source 22, the analyzer electromagnet 24, the focusing lens system 25, the RFQ accelerator 21, the acceleration-deceleration system 26, and the energy analyzer 27 constituting a beam transmission system having the described structure.

The power source 72 of high voltage corresponding to the ion source 22 generally supplies a DC high voltage of 0 to 100 kV when the charge on the extracting ions is positive. As a result, the positively charged ions are accelerated from the plasma of the ion source 22 towards the extraction electrode 23 of ground potential. On the other hand, when drawing negatively charged ions, the polarity of the power source 72 of high voltage is reversed.

The power source 74 corresponding to the analyzer electromagnet 24 is a constant current power source and supplies a constant current for generating a magnetic field in accordance with the ions to be extracted. The power source 75 corresponding to the focusing lens system 25 differs depending on the type of the focusing lens system 25: A constant current power source in the case of electromagnet quadrupole, a high voltage power source in the case of electrostatic quadrupole, and a power source for driving mechanical-electrical changing means for changing the magnitude of magnetic field in the case of permanent magnet quadrupole. The number of the power source 75 provided (three in FIG. 9) corresponds to the number of electrode stages of the focusing lens system 25.

The power source 71 corresponding to the RFQ accelerator 21, as described, is a radio-frequency power source capable of operating at a frequency in a range of 25 MHz to 50 MHz. The power source 71 supplies a radio-frequency power through a coaxial tube or coaxial cable.

The power source 76 corresponding to the acceleration-deceleration system 26 is composed of radio-frequency power sources 76*a* and power sources 76*b*, respectively corresponding to the radio-frequency acceleration tube 26*a* and the quadrupole 26*b* as shown in FIG. 10. As with the power source 71, the power source 76*a* supplies a radio-frequency power in the above frequency range to the inductors 62 and 63 of the radio-frequency acceleration tube 26*a* via a coaxial tube or coaxial cable. As in the case of the power source 75 of the focusing lens system 25, the power source 76*b* constitutes a constant current power source when the quadrupole 26*b* is an electromagnetic lens, and constitutes a high voltage power source when the quadrupole 26*b* is an electrostatic lens.

The power source 77 corresponding to the energy analyzer 27 constitutes a constant voltage power source when the energy analyzer 27 is of electromagnetic type, and constitutes a high voltage power source when the energy analyzer 27 is of electrostatic type.

The power sources 72, 74, 75, 71, 76, and 77 are connected to one another via a control device 80, which is realized by a micro computer, etc., and via an analog or digital interface, so that the power sources 72, 74, 75, 71, 76, and 77 are communicatable with one another. The power sources 72, 74, 75, 71, 76, and 77 are controlled in accordance with an automatic processing program or manual operation by an operator. The high energy ion implanter is arranged in the described manner.

Note that, the concept of the ion implanter of the present invention includes an ion irradiating device, which carries out ion irradiation over a wide range with a beam diameter, for example, as large as several ten centimeters so as to change the surface property of an irradiation target.

INDUSTRIAL APPLICATIONS OF THE PRESENT INVENTION

As described, an RFQ accelerator in accordance with the present invention includes RFQ electrodes whose configuration is optimized so that power efficiency is high, cooling efficiency is superior, mechanical strength is sufficient, and beam acceptance is large, allowing the RFQ accelerator to be adopted as an RFQ accelerator for use as an acceleration tube, etc., of a high energy ion implanter.

Also, as described, an ion irradiating device or ion implanter in accordance with the present invention adopts the above RFQ accelerator as an acceleration tube, allowing the ion irradiating device or ion implanter to be suitably adopted as a high energy ion irradiating device or high energy ion implanter.

What is claimed is:

1. An RFQ accelerator in which four electrodes extending in a beam propagation direction are positioned at 90° angle to one another in a cylindrical vacuum chamber, each pair of the four electrodes on a diagonal line being connected to posts, adjacent electrodes of the four electrodes facing each other on a crest portion and a trough portion formed on an electrode surface, said RFQ accelerator accelerating an ion beam guided to a beam passage spacing surrounded by the four electrodes by radio-frequency electric fields induced between adjacent electrodes, wherein a radius $R_1$ of the beam passage spacing surrounded by the four electrodes is selected from a range of 5 mm to 9 mm, a curvature $R_2$ of the crest portion in a direction perpendicular to an axis of the four electrodes is selected from a range of 5 mm to 9 mm, and a height H from a peak of the crest portion to a bottom surface is selected so that a ratio of $H/R_1$ is in a range of 4 to 6.

2. The RFQ accelerator as set forth in claim 1, wherein each of the four electrodes has partial expanded portions on the bottom surface, the expanded portions being provided with bolt holes, side surfaces of the expanded portions brought into contact with the posts so that each of the four electrodes is fixed to the posts by bolts.

3. The RFQ accelerator as set forth in claim 1, wherein each of the four electrodes has a substantially pentagonal cross section perpendicular to the axis, the electrode surface, which meets the beam passage spacing, being composed of circular arc forming the crest portion or the trough portion and inclined linear surfaces continuing from the circular arc.

4. The RFQ accelerator as set forth in claim 1, wherein each of the four electrodes is provided with a coolant channel in the beam propagation direction, the coolant channel being a cavity machined inside the each of the four electrodes.

5. The RFQ accelerator as set forth in claim 1, wherein the posts for supporting the four electrodes are positioned so that intervals between adjacent posts are equal on one side of the four electrodes.

6. An ion implanter, comprising:

an ion source for generating ions;

an extraction electrode for drawing ions by accelerating ions generated in said ion source to a predetermined initial energy;

an analyzer electromagnet for extracting only desired ions from the ions drawn by said extraction electrode;

a focusing lens system for focusing ions from said analyzer electromagnet to have a beam diameter suitable for acceleration;

an RFQ accelerator as defined in any one of claims 1 through 5 for accelerating ions from said focusing lens system to a desired energy so as to irradiate the ions on or implant the ions in a target; and an acceleration-deceleration system, provided as required on a following stage of said RFQ accelerator, for further accelerating or decelerating the ions.

* * * * *